US005927847A

United States Patent [19]

Cales et al.

[11] Patent Number: 5,927,847

[45] Date of Patent: Jul. 27, 1999

[54] BOAT LANTERN HOLDER

[76] Inventors: Dwayne A. Cales, 3121 Main St.; Wesley Leland Gwinn, P.O. Box 426, both of Meadow Bridge, W. Va. 25976

[21] Appl. No.: 08/723,776

[22] Filed: Sep. 30, 1996

[51] Int. Cl.[6] ..... F21S 13/10

[52] U.S. Cl. ..... 362/431; 362/191; 362/477

[58] Field of Search ..... 362/431, 396, 362/171, 181, 61, 75, 477, 191; 431/343

[56] References Cited

U.S. PATENT DOCUMENTS 3,725,696 4/1973 Morton ..... 362/399

3,998,418 12/1976 Boulanger ..... 248/309.1

*Primary Examiner*—Stephen Husar

[57] ABSTRACT

The invention herein is a boat lantern holder which will hold a propane type lantern or a pump up flammable liquid type lantern by inserting the device into a boat seat socket which is commonly found on the decks of both small and large boats and especially bass boats where it has the advantage of being mounted on the centerline of the boat making it especially useful by providing a mounting above the boat deck where the light of the lantern held radiates to all points of the area surrounding the boat providing excellent visibility for the user of the device and to other boaters in the nearby vicinity preventing collision on the water at night.

1 Claim, 1 Drawing Sheet

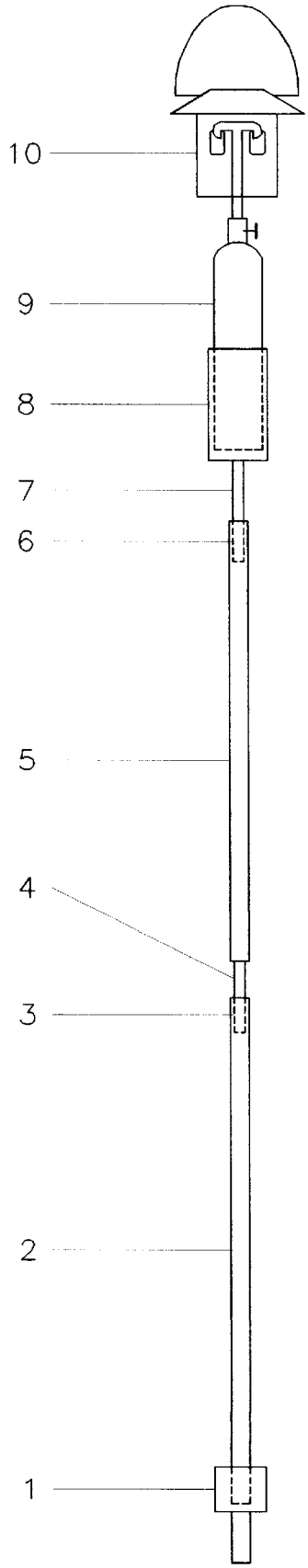
10
9
8
7
6
5
4
3
2
1

BOAT LANTERN HOLDER

BACKGROUND OF THE INVENTION

The present invention relates to a lantern holding device which can be inserted into the boat seat socket on boats provided with swivel boat seat sockets mounted in the boat deck or other places.

Boaters and fishermen have always had the need for lights on boats to help them see while they are engaged in moving about the boat or fishing in the dark and some navigation laws require a white light be present at night if the boat is anchored or not under way. There also has been a need for a lantern holder which could be made to hold a propane lantern as well as conventional pump up lanterns in a safe and practical manner upon the deck of a boat.

DESCRIPTION OF PRIOR ART

Various pole and socket designs have been issued. Patents such as: U.S. Pat. No. 240,663 Coleman, U.S. Pat. No. 2,297,916 Sauer, U.S. Pat. No. 3,998,418 Boulanger, U.S. Pat. No. 4,625,937 Haase, U.S. Pat. No. 4,827,389 Crum, U.S. Pat. No. 5,339,225 Wiggerman.

U.S. Pat. No. 240,663 issued to Mr. Coleman consists of a pole which is inserted into a hole bored into a thwart of a boat and the holder itself consists of a sectional device which when drawn togather provides a clamping action upon the base of the lantern.

The present invention can be mounted in any boat seat socket and requires no clamping device. U.S. Pat. Nos. 3,998,418 and 4,625,937 hold the lantern by the lantern bail which may allow movement of the lantern unless secured by extra appliances. A propane cylinder becomes the base of a propane lantern when screwed onto the lantern head. The present invention holds the lantern by the base by friction of the sidewalls of the holder upon the sides of the lantern base and by the weight of the lantern.

U.S. Pat. Nos. 4,827,389 and 5,339,225 operate with electric lights which require batteries and if electric power is used from the boat motor starting battery,excessive power drain may result in a inability to start the boat motor.

SUMMARY OF THE INVENTION

The present invention relates to a lantern holder which can be inserted into a boat seat socket of any boat having swivel seat sockets mounted in its deck or any other place a swivel boat seat socket is provided on a boat. The lantern holder consists of a tube formed of sheet metal or other materials with a short piece of tubing afixed to the bottom of it. The short piece of tubing is inserted into a socket located inside of a staff or pole which can be made of one long piece of tubing or pipe with a socket located in the top end,or it can be made sectional so it can be taken apart and be easily stowed away.

The base is made of solid steel or other material with a hole bored in one end into which the staff or pole is inserted and welded or afixed in a solid manner. The bottom half of the base is formed in the shape of a shaft which is machined to fit the hole diameter of the boat seat socket. It is inserted into the boat seat socket. The lantern base, which in the case of a propane lantern, is the propane cylinder tank, is pushed by hand downward into the lantern holder tube and held in place by the friction of the sidewalls of the tube and the weight of the lantern.

The lantern holder tube can be made in two sizes to accomodate the long slim propane cylinders or the short wide diameter cylinders.

Any brand or model of propane lantern can be used because the tube is made to fit the propane cylinder. The lantern holder can also be be made to fit a lantern of the pump up flammable liquid type such as the Coleman pump up lantern or other brands as long as it is made with straight, vertical tank sides. The tube would be formed to fit the liquid fuel tanks height and diameter depending on the particular lantern.

It is the object of this invention to provide a lantern holder which will hold a lantern of the propane or flammable liquid pump up type on a boat in a vertical and ridgid manner above the deck of a boat by means of a lantern holder which is inserted into the swivel boat seat socket hole which is normally mounted in the deck or other places on a boat.

It is also the object of this invention to provide a universal lantern holder which will hold any make or brand of propane lantern by its base, which is a propane cylinder tank which is screwed onto the lintern head, by means of inserting the propane cylinder tank into a tubular lantern holder which holds by friction of the tube walls upon the propane cylinder tank sides and by weight of the lantern.

It is also the object of this invention to provide a lantern holder which uses a single staff or pole or a sectional staff or pole assembly which can be assembled and disassembled readily and which is inserted into a swivel boat seat socket on a boat.

It is also the object of this invention to provide a safe, rigid mounting for a lantern on a boat.

It is also the object of this invention to provide a lantern holder which will hold the lantern high above the deck and thereby keeping the light out of the boaters eyes and to draw insects away from the boater.

It is also the object of this invention t provide a lantern holder which will hold a flammable liquid pump up type lantern by a tubular holder into which the fuel tank of such a lantern is inserted.

BRIEF DESCRIPTION OF THE DRAWING

The sole FIGURE is a perspective view of the boat lantern holder of the present invention.

DETAILED DESCRIPTION OF THE INVENTION

The boat lantern holder includes No. 1 which is the base which can be made by machining a piece of round stock in which the lower half is machined small enough to be inserted into a boat seat socket and yet maintain a tight fit in which no or little side movement will be present.

The upper half is machined so it is larger in diameter than the boat seat socket and the lower half of the base, so as to prevent the base from being inserted into the boat seat socket any farther than necessary. The upper half also has a hole bored into it into which No. 2, the lower pole is inserted and affixed by any means resulting in a tight connection.

At the top of the lower pole, No. 2 is a socket No. 3 into which No. 4 is inserted, No. 4 being the male part of the connection and No. 3 the female. No. 4 is held by weight and friction inside the socket, No. 3.

No. 5 is the upper pole which raises the lantern even higher above the boat deck. At the top of the upper pole No. 5, is found a female socket No. 6 into which No. 7 is inserted. No. 7 is a piece of tube or round stock, or other material which is afixed to the bottom of No. 8 which when afixed becomes the lantern holder. No. 8 can be made of sheet metal rolled into a tube and soldered or joined in another manner. The inside diameter of the tube should be made to be of asize that will permit a very tight sliding fit when the propane cylinder No. 9 is inserted into it.

The tube can be made of different diameters and lengths to accomodate different size propane cylinders or the fuel tanks of pump up, flammable liquid type lanterns.

The tube when made for a propane cylinder should be of a length to accomodate at least half the length of the propane cylinder, and when being made for a flammable liquid type pump up lantern the tube should enclose as much of the fuel tank as possible and also be a very tight fit.

After making the tube No. 8, a bottom must be made for the tube and this can be done by making a disc which is inserted into one end of the tube and fastened to the tube sides by any number of methods. This becomes the bottom and No. 7 is affixed to this. The tube could also be stamped out in a press forming the sides and bottom out of one piece of material.

After No. 10 the lantern head, is screwed onto No. 9 the propane cylinder, the cylinder is inserted into No. 8 the tube and is held very tightly by friction of the tube sides and by the weight of the combined lantern cylinder assembly.

Once the whole assembly is put together it is inserted into the boat seat socket and it will hold the lantern above the boat deck in a safe and rigid manner.

The boat lantern holder assembly could be made in a unsegmented manner therefore the above description shall not be construed as limiting the ways in which this invention may be practiced but shall be inclusive of many other variations that do not depart from broad interest and intent of the invention.

I claim:

1. A lantern holder which rigidly supports a lantern in a vertical position above a boat seat socket in a boat comprising:

a cylindrical tube having an inner wall, the diameter of said inner wall being of a size which provides a friction fit between said inner wall and a fuel tank part of said lantern, said lantern, said cylindrical tube further being open at one end and closed at the opposite end;

a pole having one end connected to the closed end of said cylindrical tube, said pole further having an opposite end connected to a recessed portion of a stepped base support member.

* * * * *